US008683911B2

(12) United States Patent
Ishibashi et al.

(10) Patent No.: US 8,683,911 B2
(45) Date of Patent: Apr. 1, 2014

(54) LINEAR ACTUATOR

(75) Inventors: Koichiro Ishibashi, Tsukubamirai (JP); Seiji Takanashi, Noda (JP); Motohiro Sato, Toride (JP); Jiro Mandokoro, Moriya (JP); Koji Hara, Tsukubamirai (JP); Toshio Sato, Tsukuba (JP)

(73) Assignee: SMC Kabushiki Kaisha, Tokyo (JP)

( * ) Notice: Subject to any disclaimer, the term of this patent is extended or adjusted under 35 U.S.C. 154(b) by 918 days.

(21) Appl. No.: 12/813,879

(22) Filed: Jun. 11, 2010

(65) Prior Publication Data

US 2011/0162519 A1 Jul. 7, 2011

(30) Foreign Application Priority Data

Jan. 5, 2010 (JP) ..... 2010-000564

(51) Int. Cl.
*F15B 15/00* (2006.01)
*F15B 13/00* (2006.01)

(52) U.S. Cl.
USPC ..... 91/508

(58) Field of Classification Search
USPC ..... 91/508; 92/88, 146, 169.1
See application file for complete search history.

(56) References Cited

U.S. PATENT DOCUMENTS

| | | | | |
|---|---|---|---|---|
| 4,748,866 | A | 6/1988 | Weyer | |
| 5,363,741 | A | 11/1994 | Hosono et al. | |
| 5,884,549 | A | 3/1999 | Hosono et al. | |
| 7,090,400 | B2 * | 8/2006 | Kato et al. | 384/44 |
| 7,806,041 | B2 * | 10/2010 | Someya et al. | 92/146 |

FOREIGN PATENT DOCUMENTS

| | | | |
|---|---|---|---|
| CN | 1815046 | A | 8/2006 |
| CN | 2837045 | Y | 11/2006 |
| JP | 59-058215 | | 4/1984 |
| JP | 2586276 | | 9/1998 |
| JP | 2001-263349 | | 9/2001 |
| JP | 3795968 | | 4/2006 |
| JP | 2007-218296 | | 8/2007 |
| JP | 2009-150455 | | 7/2009 |
| KR | 1998-024027 | | 7/1998 |
| KR | 10-2008-0049675 | | 6/2008 |
| TW | 460661 | | 10/2001 |
| TW | M310272 | | 4/2007 |
| TW | 200823373 | A | 6/2008 |
| TW | 200934963 | A | 8/2009 |

OTHER PUBLICATIONS

U.S. Appl. No. 12/981,214, filed Dec. 29, 2010, Ishibashi, et al.

(Continued)

*Primary Examiner* — Edward Look
*Assistant Examiner* — Logan Kraft
(74) *Attorney, Agent, or Firm* — Oblon, Spivak, McClelland, Maier & Neustadt, L.L.P.

(57) ABSTRACT

A linear actuator includes a guide block constituting a guide mechanism. In the guide block, a pair of installation grooves are formed in a lower surface facing toward a cylinder main body. Ball circulation members having therein ball circulation holes are installed respectively in the installation grooves. Additionally, ball circulation passages through which balls circulate are provided. The ball circulation passages are made up from roll-reversing sections disposed on opposite ends of the ball circulation members, the ball circulation holes, second ball guide grooves formed in both side surfaces of the guide block, and first ball guide grooves of the slide table.

7 Claims, 10 Drawing Sheets

(56) References Cited

OTHER PUBLICATIONS

Notice of Allowance issued Apr. 3, 2012 in Korean Patent Application No. 2010-61823 (with English translation).
U.S. Appl. No. 13/042,629, filed Mar. 8, 2011, Ishibashi, et al.
U.S. Appl. No. 12/813,946, filed Jun. 11, 2010, Ishibashi, et al.
Combined Office Action and Search Report issued Jan. 14, 2013 in Taiwanese Patent Application No. 099119239 with English language translation.
Japanese Office Action (2010-088546) dated Oct. 29, 2013 (with English Translation of Pertinent Portion).
Japanese Office Action (2010-000564) dated Oct. 29, 2013 (with English Translation of Pertinent Portion).

* cited by examiner 10
58b
64
86
18
82
58a
72
66a
52
72
62
56
72
76b
76a
72
14
54
78
98
118
16
120
122
94b
112
74
60
111
96
92
112
98
96
94a
30b
20
30a
12
32
24
38
38
24
B
A
22
22

LINEAR ACTUATOR

CROSS-REFERENCE TO RELATED APPLICATION

This application is based upon and claims the benefit of priority from Japanese Patent Application No. 2010-000564 filed on Jan. 5, 2010, of which the contents are incorporated herein by reference.

BACKGROUND OF THE INVENTION

1. Field of the Invention

The present invention relates to a linear actuator in which, by introduction of a pressure fluid from fluid inlet/outlet ports, a slide table is made to move reciprocally along an axial direction of a cylinder main body.

2. Description of the Related Art

Heretofore, a linear actuator, for example made up of a fluid pressure cylinder or the like, has been used as a means for transporting workpieces. As disclosed in Japanese Patent No. 3795968, the present applicants have proposed a linear actuator, which is capable of transporting a workpiece that is loaded onto a slide table by causing the slide table to move reciprocally in a straight line along a cylinder main body. However, with the aforementioned linear actuator, in recent years, there has been a demand to reduce both the size and cost of the apparatus.

SUMMARY OF THE INVENTION

A general object of the present invention is to provide a linear actuator, which makes it possible to reduce a size and scale thereof and lower the manufacturing cost of the linear actuator.

The present invention is a linear actuator in which, by introduction of a pressure fluid from fluid inlet/outlet ports, a slide table is made to move reciprocally along an axial direction of a cylinder main body, comprising:

the cylinder main body, which communicates with the inlet/outlet ports and having a cylinder chamber into which the pressure fluid is introduced;

the slide table, which moves reciprocally along the axial direction of the cylinder main body;

a cylinder mechanism having a piston which is slidable along the cylinder chamber, wherein the slide table is made to move reciprocally under a displacement action of the piston;

a guide mechanism for guiding the slide table along the axial direction of the cylinder main body, the guide mechanism being attached to the cylinder main body and having a flat guide block with first circulation passages formed therein through which a plurality of rolling bodies roll and circulate; and circulation members installed in the guide block and each having a second circulation passage therein through which the rolling bodies roll and circulate, wherein openings into which the circulation members are installed are formed in the guide block.

According to the present invention, openings are formed in the guide block that constitutes the guide mechanism, and other circulation members apart from the guide block are installed with respect to the openings, the other circulation members having second circulation passages through which the rolling bodies roll. Owing thereto, it is unnecessary for circulation passages through which the rolling bodies roll to be formed inside the guide block by means of specialized processing or the like, whereby manufacturing costs and the number of processing steps can be reduced. In addition, since the space which ordinarily would be required for fabricating such circulation passages in the guide block is rendered unnecessary, the thickness dimension of the guide block can be suppressed (i.e., made thinner), and along therewith, the guide block itself can be made smaller in scale. Consequently, the guide mechanism including the guide block can have a thinner profile, so that the height dimension of the linear actuator can be made smaller overall.

The above and other objects features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENTS

Figure 1:
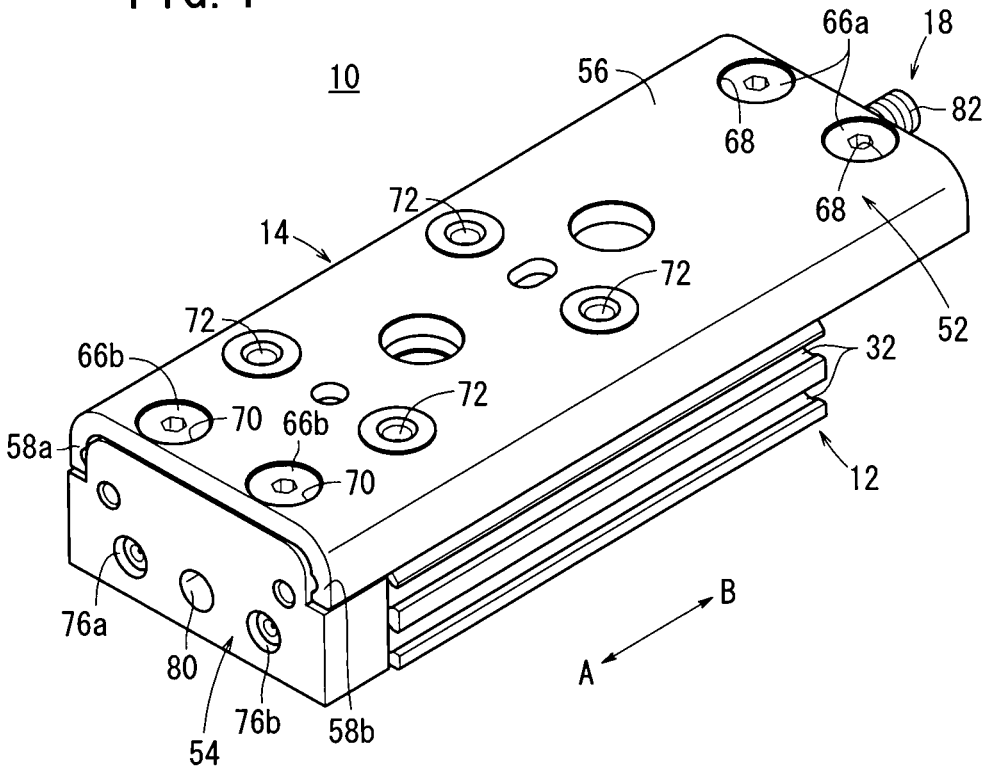
FIG. 1 is an exterior perspective view of a linear actuator according to an embodiment of the present invention.
Figure 2:
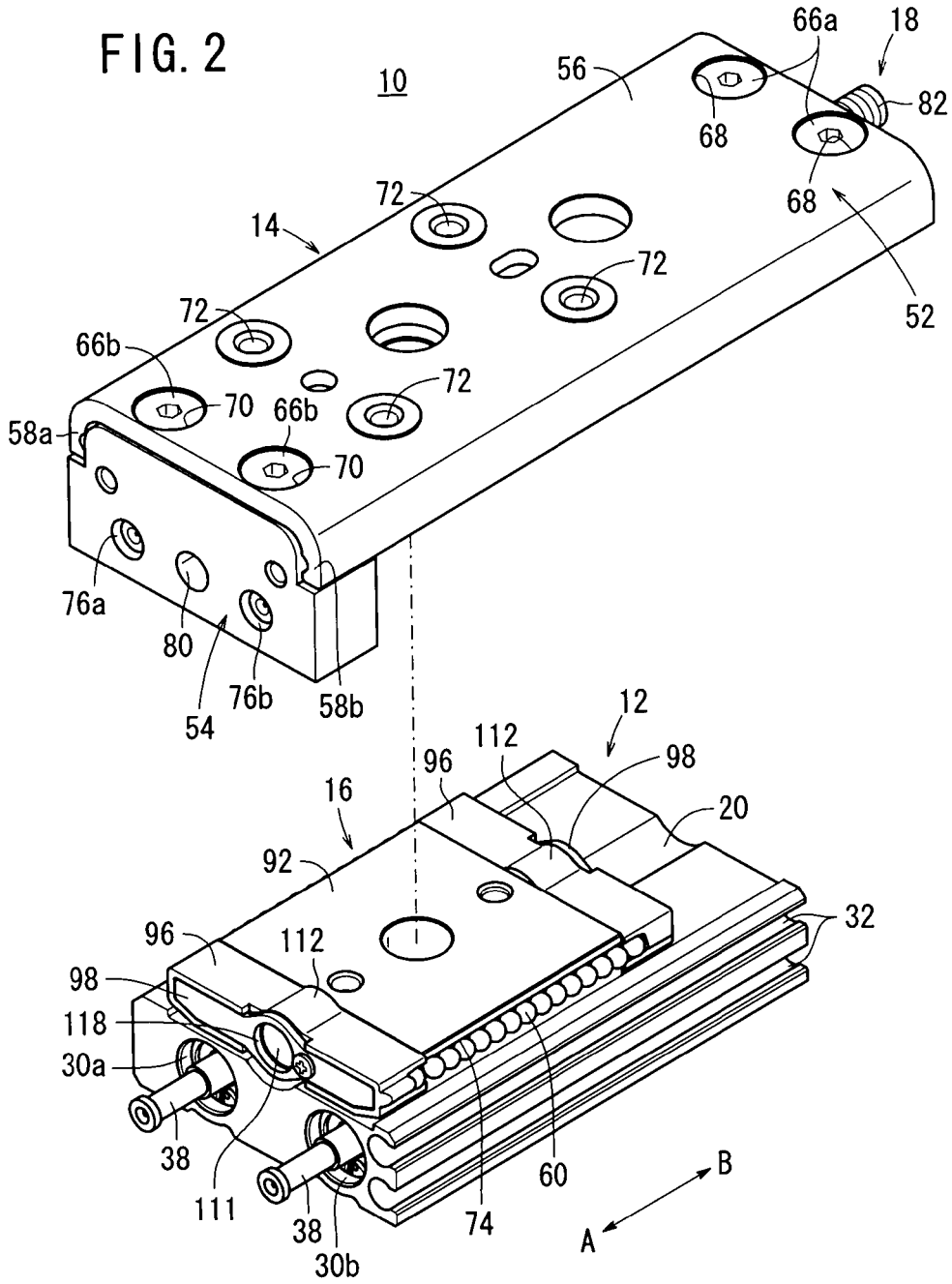
FIG. 2 is an exploded perspective view showing a condition in which a slide table is separated upwardly away from the linear actuator of FIG. 1.
Figure 3:
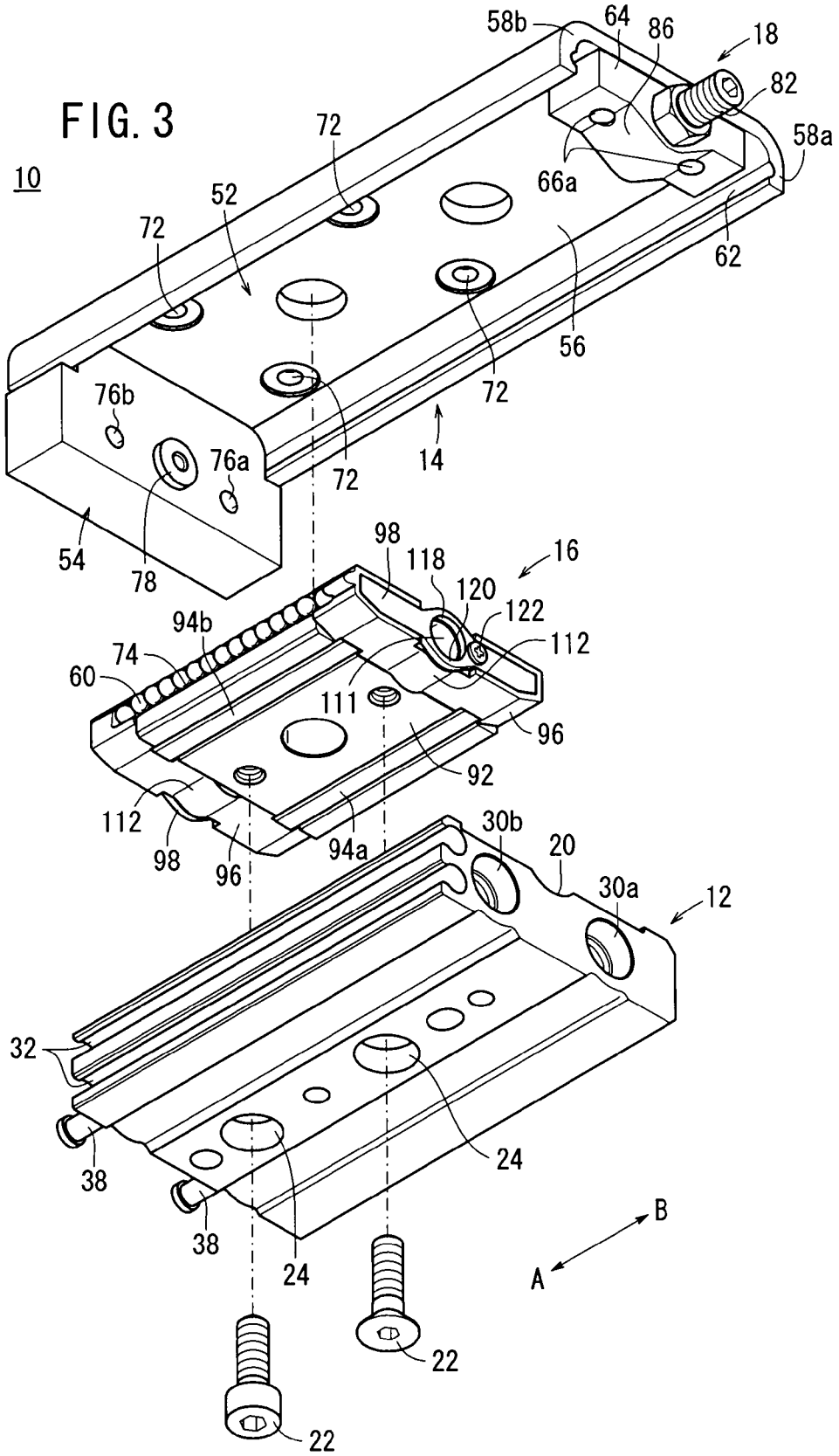
FIG. 3 is an exploded perspective view as seen from a lower side of the linear actuator of FIG. 1.
Figure 4:
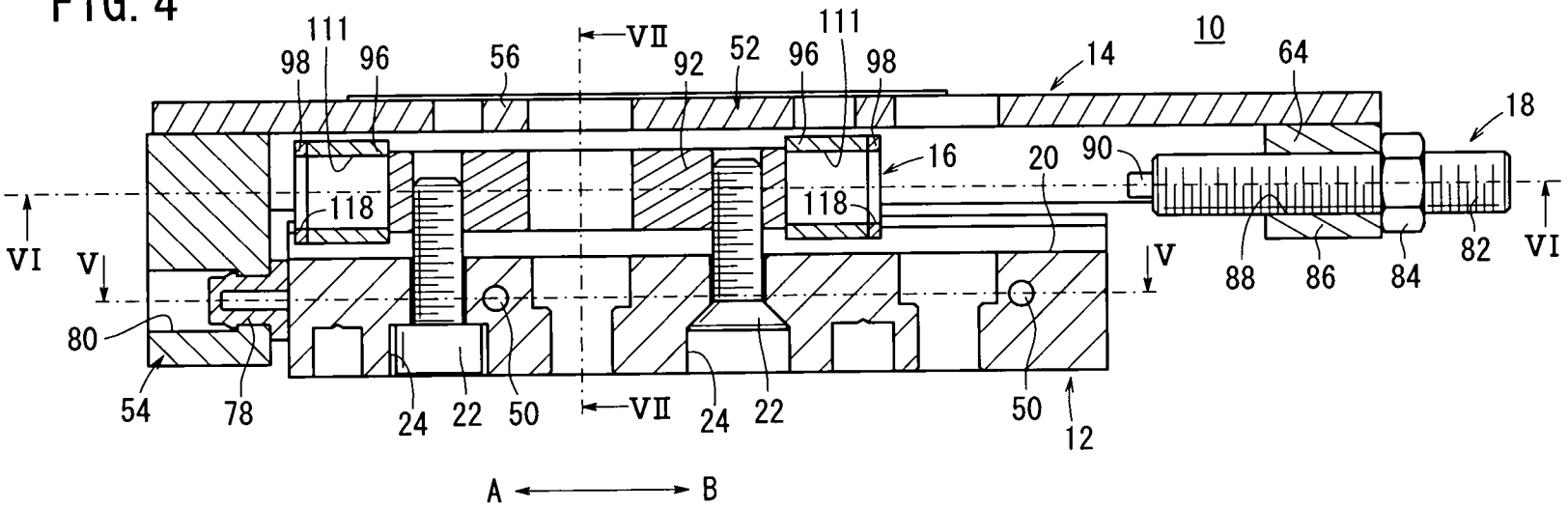
FIG. 4 is an overall vertical cross sectional view of the linear actuator of FIG. 1.

In FIG. 1, reference numeral 10 indicates a linear actuator according to an embodiment of the present invention.

As shown in FIGS. 1 through 7, the linear actuator 10 comprises a cylinder main body 12, a slide table 14 disposed on an upper portion of the cylinder main body 12 and which makes reciprocal motion in a straight line along a longitudinal direction (the direction of arrows A and B), a guide mechanism 16 disposed to intervene between the cylinder main body 12 and the slide table 14, for guiding the slide table 14 in the longitudinal direction (the direction of arrows A and B), and a stopper mechanism 18, which is capable of adjusting a displacement amount of the slide table 14.

The cylinder main body 12 has a rectangular cross section and has a predetermined length along the longitudinal direction (the direction of arrows A and B). A recess 20 having a sunken arcuate shape in cross section is formed roughly in the center on the upper surface of the cylinder main body 12, extending along the longitudinal direction (the direction of arrows A and B). In the recess 20, a pair of penetrating bolt holes 24 is provided, through which connecting bolts 22 are inserted for connecting the cylinder main body 12 with the guide mechanism 16.

Figure 5:
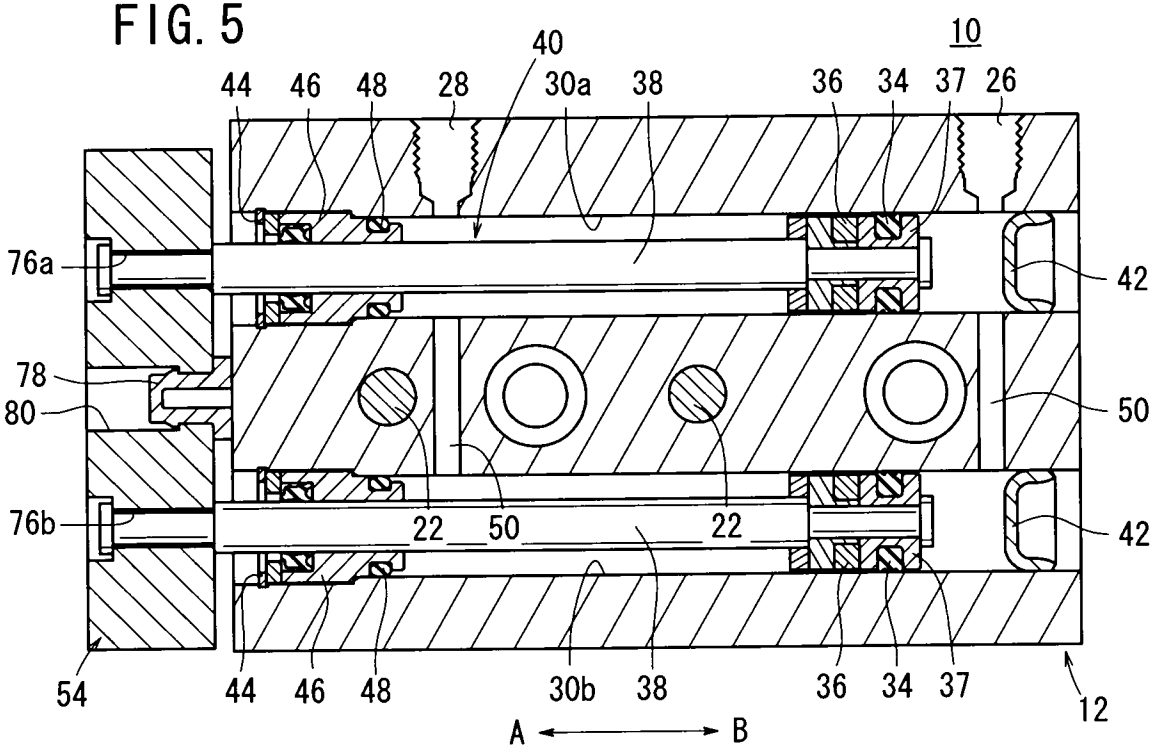
FIG. 5 is a cross sectional view taken along line V-V of FIG. 4.
Figure 6:
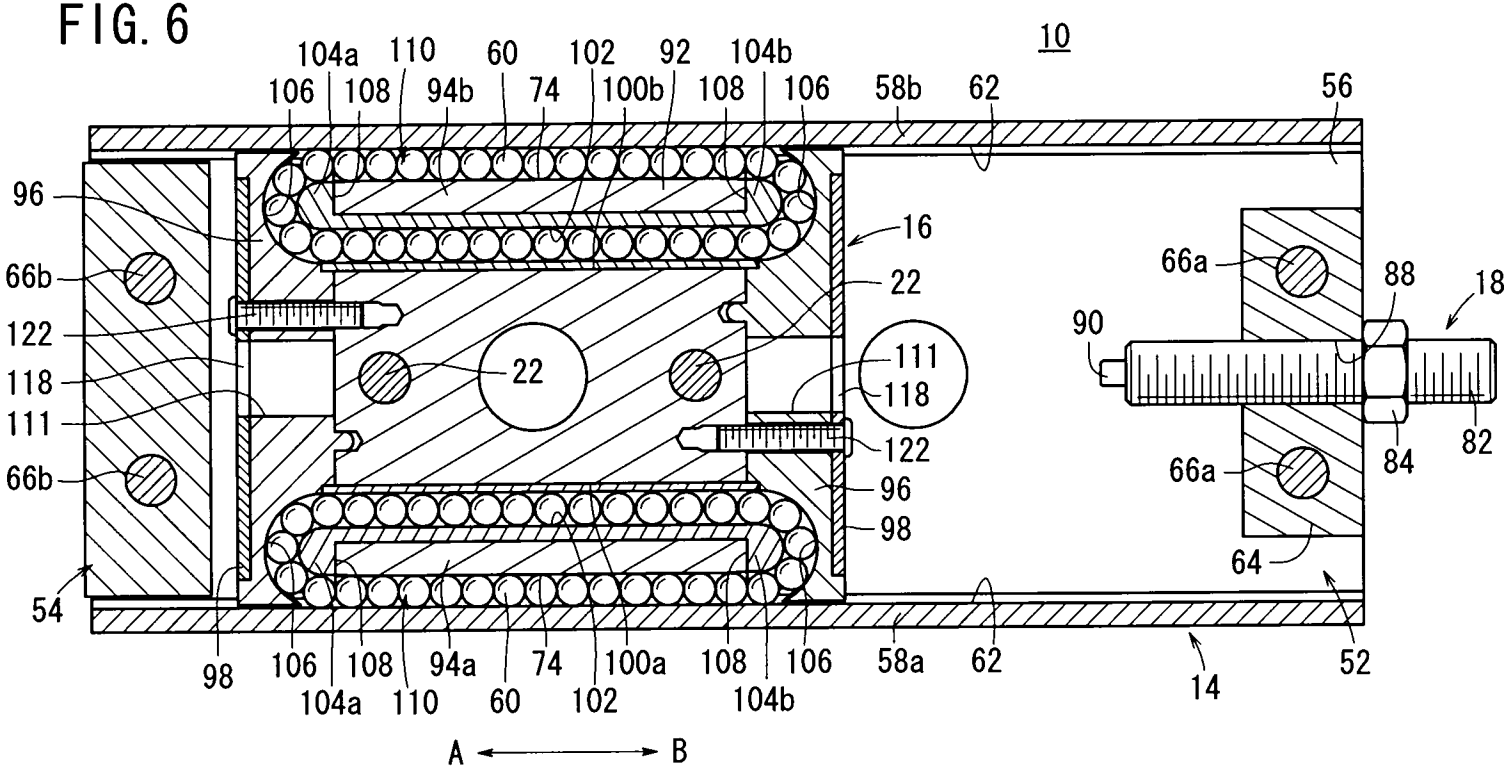
FIG. 6 is a cross sectional view taken along line VI-VI of FIG. 4.

Further, as shown in FIG. 5, on one side surface of the cylinder main body 12, first and second ports (fluid inlet/outlet ports) 26, 28 for supply and discharge of a pressure fluid are formed perpendicularly to the longitudinal direction of the cylinder main body 12, which communicate with a pair of penetrating holes (cylinder chambers) 30*a*, 30*b* to be described later. Furthermore, on the other side surface of the cylinder main body 12, two sensor attachment grooves 32 are formed respectively at positions along the longitudinal direction (the direction of arrows A and B), which have sensors (not shown) mounted therein.

On the bottom surface of the cylinder main body 12, a pair of bolt holes 24 are formed centrally in the widthwise direction on the axial line. Connecting bolts 22 are inserted through the bolt holes 24 from below. Additionally, the ends of the connecting bolts 22 project from the upper surface of the cylinder main body 12, and are connected mutually by threaded engagement with a guide block 92 of the guide mechanism 16.

On the other hand, inside the cylinder main body 12, two penetrating holes 30*a*, 30*b* are formed, which penetrate along the longitudinal direction (the direction of arrows A and B), the one penetrating hole 30*a* and the other penetrating hole 30*b* being disposed substantially in parallel to each other and separated by a predetermined distance. Inside the penetrating holes 30*a*, 30*b*, a cylinder mechanism 40 is provided, including respective pistons 37 each of which has a sealing ring 34 and a magnet 36 installed on the outer circumference thereof, and piston rods 38 connected to the pistons 37. The cylinder mechanism 40 is constituted by the pair of pistons 37 and piston rods 38, which are installed respectively in the pair of penetrating holes 30*a*, 30*b*.

The penetrating holes 30*a*, 30*b* are closed and sealed at one end thereof by caps 42, whereas other ends of the penetrating holes 30*a*, 30*b* are sealed hermetically by rod holders 46, which are retained therein via locking rings 44. On the outer periphery of the rod holders 46, o-rings 48 are installed via annular grooves, for thereby preventing leakage of pressure fluid through gaps between the penetrating holes 30*a*, 30*b* and the rod holders 46.

Furthermore, one of the penetrating holes 30*a* communicates respectively with the first and second ports 26, 28, whereas the other penetrating hole 30*b* also communicates mutually with the one penetrating hole 30*a* via a pair of connecting passages 50 formed between the one penetrating hole 30*a* and the other penetrating hole 30*b*. More specifically, the pressure fluid is supplied to the first and second ports 26, 28 and introduced into the one penetrating hole 30*a*. Thereafter, the pressure fluid also is introduced into the other penetrating hole 30*b* through the connecting passages 50. The connecting passages 50 are formed perpendicularly to the direction of extension (the direction of arrows A and B) of the penetrating holes 30*a*, 30*b*.

The slide table 14 comprises a table main body 52, a stopper mechanism 18 connected to one end of the table main body 52, and an end plate 54 connected to the other end of the table main body 52. The end plate 54 is connected perpendicularly with respect to the table main body 52.

The table main body 52 is made up from a base member 56 that extends along the longitudinal direction with a predetermined thickness, and a pair of guide walls (guide members) 58*a*, 58*b* that extend downward perpendicularly from both sides of the base member 56. On inner surfaces of the guide walls 58*a*, 58*b*, first ball guide grooves 62 for guiding balls (rolling bodies) 60 of a guide mechanism 16 (to be described later) are formed. The first ball guide grooves 62 are recessed with substantially semicircular shapes in cross section. Further, the base member 56 and the guide walls 58*a*, 58*b* are formed with substantially the same thickness dimension (see FIG. 7).

Further, on one end of the table main body 52, a pair of first bolt holes 68 is formed, through which bolts 66*a* are inserted for fixing a later-described holder portion 64 of the stopper mechanism 18. On the other end of the table main body 52, a pair of second bolt holes 70 is formed, through which bolts (fastening member) 66*b* are inserted for fixing the end plate 54. The first and second bolt holes 68, 70 penetrate in a direction perpendicular to the direction of extension of the table main body 52.

Four workpiece retaining holes 72 are formed in the base member 56 between the one end and the other end thereof. The workpiece retaining holes 72 are separated mutually by predetermined distances, such that when the slide table 14 is disposed on the upper portion of the cylinder main body 12, the workpiece retaining holes 72 are disposed toward the center side along the widthwise direction of the cylinder main body 12 and the guide block 92, with respect to second ball guide grooves 74, which are provided on opposite side surfaces of the guide block 92 (see FIG. 7).

Stated otherwise, the workpiece retaining holes 72 are arranged in the slide table 14 at inner side positions from the second ball guide grooves 74 of the guide block 92.

The end plate 54 is fixed by two bolts 66*b*, which are inserted through the second bolt holes 70 formed on the other end of the table main body 52, and is disposed so as to face toward an end surface of the cylinder main body 12. The end plate 54 also is fixed to ends of the piston rods 38, which are inserted through a pair of rod holes 76*a*, 76*b* formed in the end plate 54. Owing thereto, the slide table 14 including the end plate 54 is displaceable together with the piston rods 38 along the longitudinal direction (the direction of arrows A and B) of the cylinder main body 12.

Further, on the end plate 54, a damper installation hole 80 into which a damper 78 is mounted is formed at a position between the one rod hole 76*a* and the other rod hole 76*b*. When the damper 78, which is made from an elastic material such as rubber or the like, is mounted (inserted) in the damper installation hole 80 from the other side surface of the end plate 54 on the side of the cylinder main body 12, the end portion thereof is expanded in diameter and projects outwardly from the other side surface.

More specifically, when the end plate 54 is displaced in unison with the slide table 14, by abutment of the damper 78 that projects from the other side surface of the end plate 54 against the end surface of the cylinder main body 12, generation of shocks and noises, which would be of concern if the end plate 54 were to abut directly against the cylinder main body 12, are avoided.

The stopper mechanism 18 includes a holder portion 64 disposed on a lower surface of one end of the table main body 52, a stopper bolt 82 screw-engaged with respect to the holder portion 64, and a lock nut 84 for regulating advancing and retracting movements of the stopper bolt 82. The stopper mechanism 18 is disposed so as to face toward an end surface of the guide mechanism 16, which is disposed on the cylinder main body 12.

The holder portion 64 is formed in a block-like shape and is fixed from above with respect to the base member 56 of the table main body 52 of the slide table 14 by two bolts 66*a*, which are inserted via the first bolt holes 68. The holder portion 64 includes a first bulging portion 86 that bulges downwardly with an arcuate shape in cross section roughly in the center of the holder portion 64. In the center of the holder portion 64 that includes the first bulging portion 86, a screw hole 88 is formed in which a stopper bolt 82 is screw-engaged. The screw hole 88 extends through the holder portion 64 substantially parallel to the direction of extension of the table main body 52.

More specifically, since the screw hole 88 is disposed in the center of the holder portion 64 having the first bulging portion 86, compared to a case in which such a first bulging portion 86 is not provided, the screw hole 88 can be formed at a slightly lower location.

Further, in the holder portion 64, the first bulging portion 86 extends in the axial direction, such that when the slide table 14 is displaced along the longitudinal direction, the first bulging portion 86 is inserted through the recess 20 of the cylinder main body 12.

The stopper bolt 82, for example, is made from a shank-shaped stud bolt engraved with threads on the outer peripheral surface thereof. The stopper bolt 82 has such a length that under a condition of screw-engagement in the screw hole 88 of the holder portion 64, the stopper bolt 82 projects from the screw hole 88. In addition, a lock nut 84 is screw-engaged with the stopper bolt 82 at a region projecting from an end surface of the holder portion 64.

Additionally, by threaded rotation of the stopper bolt 82 with respect to the holder portion 64, the stopper bolt 82 is displaced along the axial direction (the direction of arrows A and B), so as to approach and separate away from the guide mechanism 16. For example, after the stopper bolt 82 has been rotated so as to project a predetermined length toward the side of the guide mechanism 16 (in the direction of arrow A), the lock nut 84 is threadedly rotated to move and abut against the side surface of the holder portion 64, thereby regulating advancing and retracting movements of the stopper bolt 82.

Further, a shock-absorbing member 90 made from an elastic material projects a given length on the end of the stopper bolt 82 toward the guide mechanism 16. The shock absorbing member 90 is provided with the aim of buffering shocks when the stopper bolt 82 abuts against the end surface of the guide mechanism 16 under a displacement action of the slide table 14.

Figure 8:
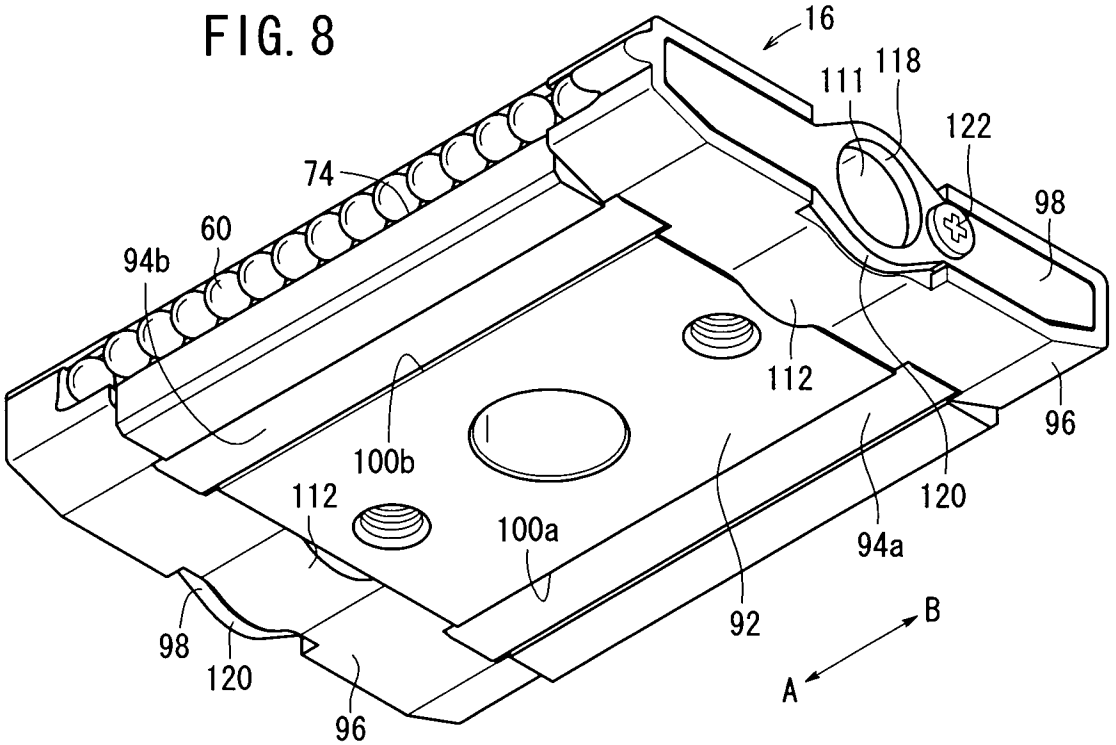
FIG. 8 is an exterior perspective view of a guide mechanism that constitutes part of the linear actuator of FIG. 1.
Figure 9:
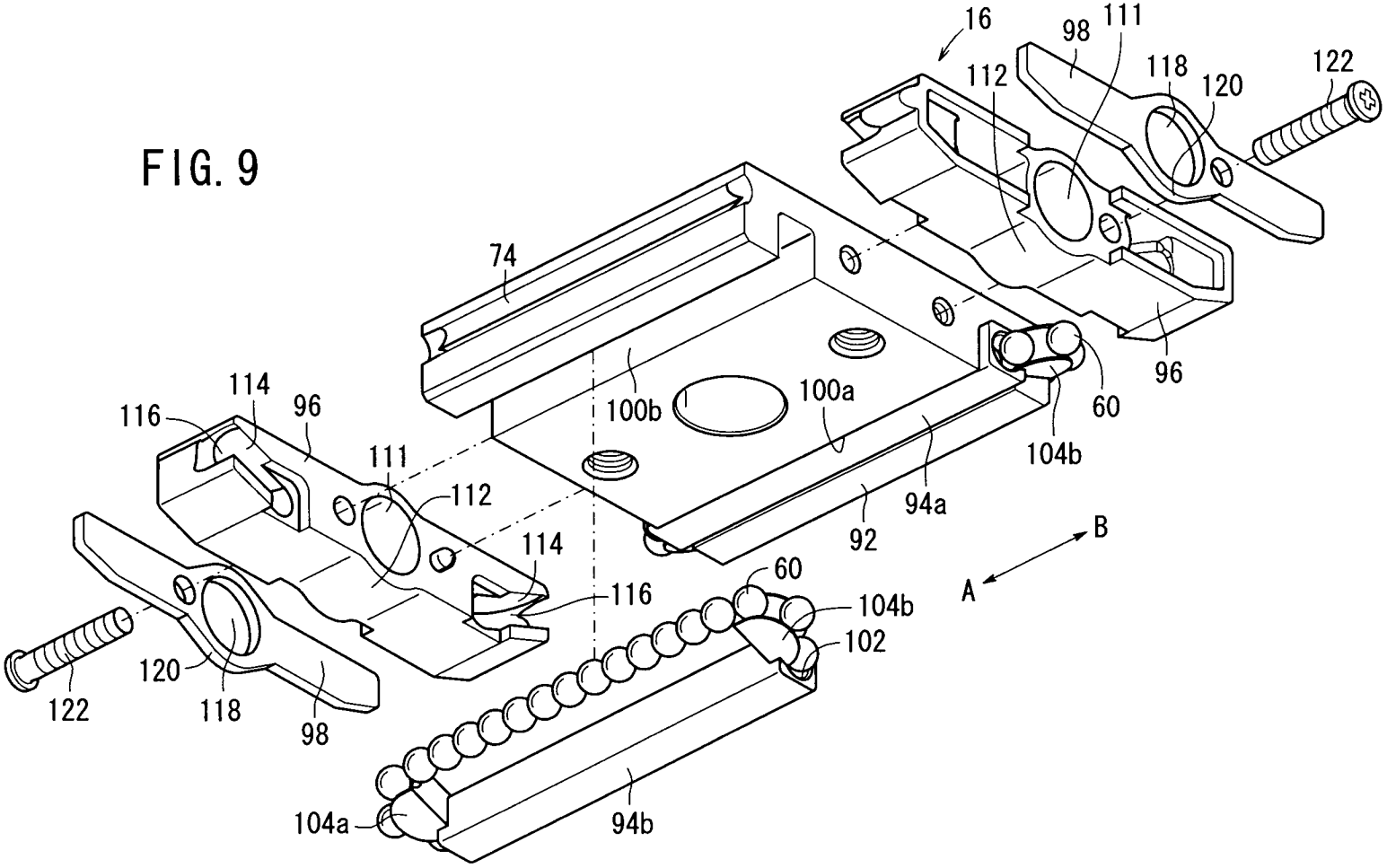
FIG. 9 is an exploded perspective view of the guide mechanism shown in FIG. 8.

As shown in FIGS. 8 and 9, the guide mechanism 16 includes the wide flat guide block 92, a pair of ball circulation members (circulation members) 94*a*, 94*b* disposed on the guide block 92 and through which the balls 60 are circulated, a pair of covers 96 installed respectively on opposite ends along the longitudinal direction of the guide block 92, and a pair of cover plates 98 for covering surfaces of the covers 96 respectively.

Second ball guide grooves 74 are formed along the longitudinal direction on both side surfaces of the guide block 92. At regions proximate to the second ball guide grooves 74, a pair of installation grooves (openings) 100*a*, 100*b*, in which the ball circulation members 94*a*, 94*b* are inserted, penetrate therethrough along the longitudinal direction. The second ball guide grooves 74 are semicircular shaped in cross section, and when the slide table 14 is arranged on the upper portion of the guide mechanism 16, the second ball guide grooves 74 are positioned in confronting relation to the first ball guide grooves 62.

The installation grooves 100*a*, 100*b* are formed on the lower surface of the guide block 92, having rectangular shapes in cross section, and open downwardly and at opposite ends in the longitudinal direction.

The ball circulation members 94*a*, 94*b* are formed with substantially rectangular shapes in cross section corresponding to the installation grooves 100*a*, 100*b* and have ball circulation holes (second circulation passages) 102 penetrating in the interior thereof through which the balls 60 circulate. On opposite ends thereof, roll-reversing sections 104*a*, 104*b* are disposed respectively for reversing the direction in which the balls 60 circulate. The roll-reversing sections 104*a*, 104*b* are formed with semicircular shapes in cross section, and ball grooves in which the balls 60 roll are formed on the outer circumferential surface of the roll-reversing sections 104*a*, 104*b*. Such ball grooves are connected continuously with the ball circulation holes 102. More specifically, the balls 60 roll from the ball circulation holes 102 in the ball circulation members 94*a*, 94*b*, via the ball grooves of the roll-reversing sections 104*a*, 104*b*, and change 180° in direction to enter into the first and second ball guide grooves (first circulation passages) 62, 74 disposed on outer sides of the ball circulation members 94*a*, 94*b*.

The ball circulation members 94*a*, 94*b* are arranged in the guide block 92 such that the ball circulation holes 102 are located downward with respect to the first and second ball guide grooves 62, 74. More specifically, the ball circulation holes 102 and the first and second ball guide grooves 62, 74 are offset by a predetermined height in the vertical direction (the direction of arrow C in FIG. 7).

Further, when the ball circulation members 94*a*, 94*b* are inserted into the installation grooves 100*a*, 100*b* of the guide block 92, flat surface portions 108 of the roll-reversing sections 104*a*, 104*b* abut respectively against end surfaces of the guide block 92 (see FIG. 6), such that the ball circulation holes 102 of the ball circulation members 94*a*, 94*b* and the second ball guide grooves 74 are interconnected.

Figure 7:
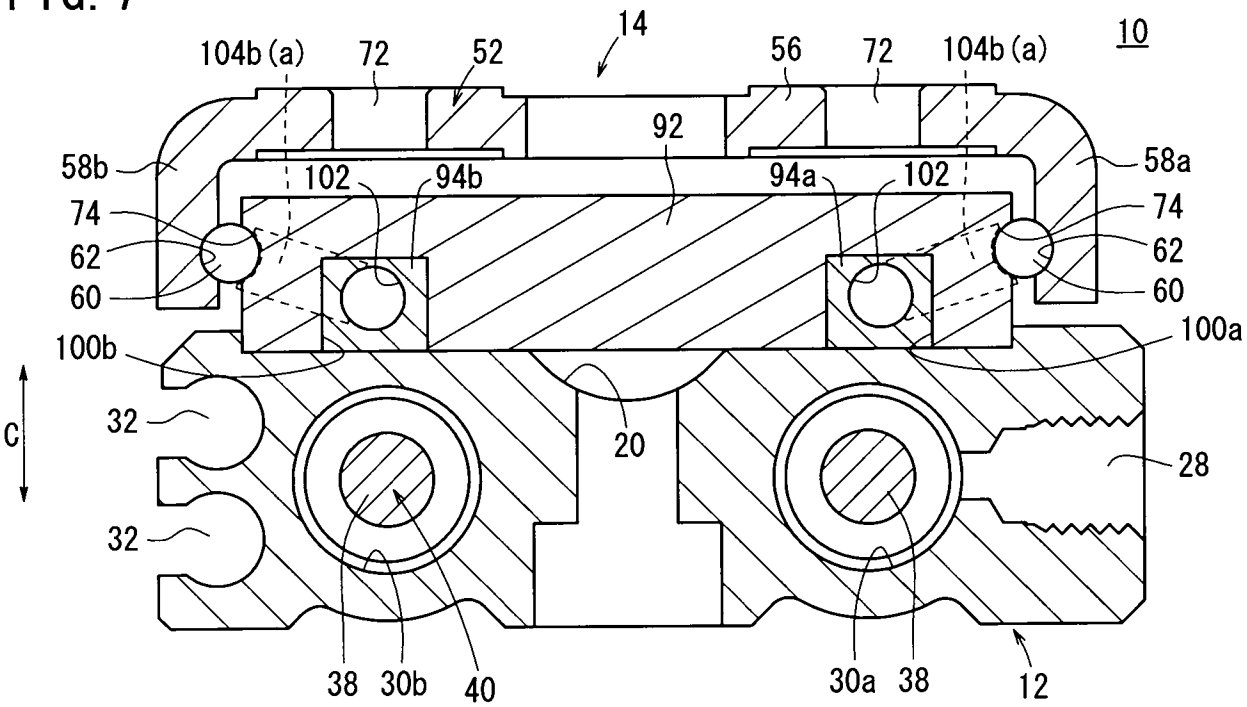
FIG. 7 is a cross sectional view taken along line VII-VII of FIG. 4.

More specifically, as shown in FIG. 7, in the guide mechanism 16, the ball circulation holes 102 and the first and second ball guide grooves 62, 74 are connected in an inclined orientation by the roll-reversing sections 104*a*, 104*b*.

Owing thereto, a continuous annular ball circulation passage 110 is formed by the ball circulation holes 102 of the ball circulation members 94*a*, 94*b*, the ball grooves, the first ball guide grooves 62 of the slide table 14, and the second ball guide grooves of the guide block 92. The plural balls 60 roll along the ball circulation passage 110, whereby the slide table 14 can be moved smoothly in a reciprocating manner along the guide mechanism 16.

Covers 96 are mounted so as to cover both end surfaces of the guide block 92. Holes 111 that penetrate in the axial direction are formed in the center of the covers 96, and second bulging portions 112 are provided, which bulge outwardly in upward and downward directions about the holes 111 respectively with arcuate shapes in cross section. The second bulging portions 112 are disposed such that when the guide mechanism 16 is mounted on the upper portion of the cylinder main body 12, the second bulging portions 112 can be inserted into the recess 20 of the cylinder main body 12.

On the other hand, inside the covers 96, spaces 114 are formed in which the roll-reversing sections 104*a*, 104*b* are accommodated, and retaining grooves 116 for retaining the balls 60 that roll within the roll-reversing sections 104*a*, 104*b* are formed in such spaces 114. The retaining grooves 116 are formed with arcuate shapes in cross section on radial outward sides of the roll-reversing sections 104*a*, 104*b*, such that the balls 60 are capable of rolling between the retaining grooves 116 and the ball grooves of the roll-reversing sections 104*a*, 104*b*.

Roughly in the center of the cover plates 98, holes 118 are formed, which are of the same diameter and coaxial with the holes 111 of the covers 96. In addition, end surfaces of the guide block 92 are exposed outwardly through the holes 111, 118, and the cover plates 98 have third bulging portions 120 thereon that bulge in upward and downward directions with arcuate shapes in cross section corresponding to the covers 96. The third bulging portions 120 are formed with substantially the same cross sectional shape as the second bulging portions 112 of the covers 96, and are disposed so as to be capable of insertion into the recess 20 of the cylinder main body 12. Further, the aforementioned covers 96 and cover plates 98 are fixed by cover fixing bolts 122 respectively to the end surfaces of the guide block 92.

In addition, when the slide table 14 moves reciprocally, the stopper bolt 82 of the stopper mechanism 18 abuts against the end surface of the guide block 92 via the holes 118, 111.

The linear actuator 10 according to the embodiment of the present invention basically is constructed as described above. Next, operations and effects of the linear actuator 10 shall be described. The state shown in FIG. 4, in which the end plate 54 of the slide table 14 abuts against the end surface of the cylinder main body 12, shall be described as an initial position.

At first a pressure fluid from a non-illustrated pressure fluid supply source is introduced into the first port 26. In this case, the second port 28 is placed in a state of being open to atmosphere under the operation of a non-illustrated switching valve.

Pressure fluid supplied to the first port 26 is supplied to one of the penetrating holes 30*a* and also is supplied to the other of the penetrating holes 30*b* through the connecting passage 50, whereby the pistons 37 are pressed (in the direction of arrow A) toward the rod holders 46. Consequently, the slide table 14 is displaced together with the piston rods 38, which are connected to the pistons 37, in a direction to separate away from the cylinder main body 12.

At this time, the balls 60 of the guide mechanism 16 roll along the ball circulation passage 110 accompanying displacement of the slide table 14, whereby the slide table 14 is guided in the axial direction by the guide mechanism 16.

Figure 10:
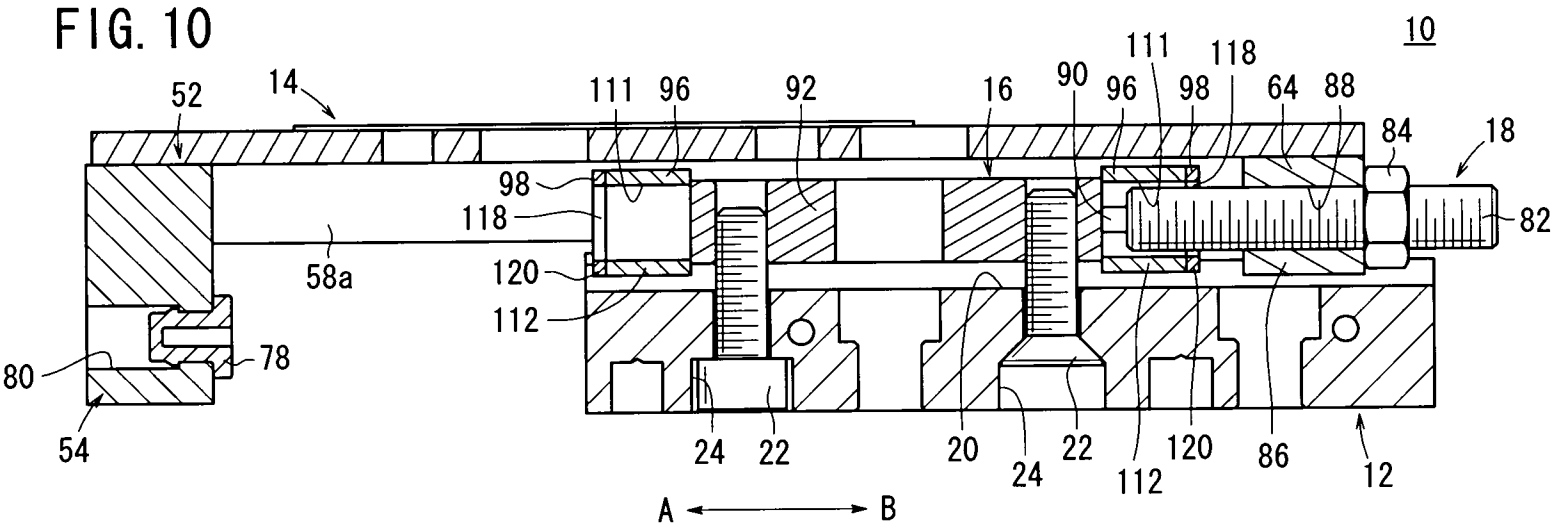
FIG. 10 is an overall vertical cross sectional view showing a condition in which an end plate of the slide table in the linear actuator shown in FIG. 4 is displaced in a direction away from the cylinder main body.

Then, as shown in FIG. 10, the end of the stopper bolt 82, which is provided at one end of the slide table 14, abuts against the end surface of the guide block 92 of the guide mechanism 16, and displacement of the slide table 14 is stopped, whereupon the slide table 14 reaches a displacement terminal end position.

After loosening the lock nut 84 to enable movement of the stopper bolt 82, the amount at which the stopper mechanism 18 projects from the end surface of the holder portion 64 may be adjusted by threaded-rotation of the stopper bolt 82, whereby the displacement amount of the slide table 14 can also be adjusted.

On the other hand, in the case that the slide table 14 is displaced in a direction opposite to the above direction, i.e., in a direction away from the displacement terminal end position shown in FIG. 10, the pressure fluid, which was supplied to the first port 26, is supplied with respect to the second port 28, whereas the first port 26 is placed in a state of being open to atmosphere. As a result, by means of the pressure fluid, which is supplied into the pair of penetrating holes 30*a*, 30*b* from the second port 28, the pistons 37 are displaced in a direction to separate away from the rod holders 46 (in the direction of arrow B), and the slide table 14 is displaced through the pistons 37 together with the piston rods 38 in a direction to approach the cylinder main body 12. Then, the damper 78, which is disposed on the end plate 54 of the slide table 14, abuts against the end surface of the cylinder main body 12, and the initial position of the linear actuator 10 is restored.

In this manner, according to the present embodiment, a structure is provided in which a pair of downwardly opening installation grooves 100*a*, 100*b* is formed on the bottom surface of the guide block 92 of the guide mechanism 16, and ball circulation members 94*a*, 94*b* having ball circulation holes 102 therein through which the balls 60 circulate, are installed and mounted respectively in the installation grooves 100*a*, 100*b*.

Owing thereto, it is unnecessary to perform a cutting process for the purpose of forming the ball circulation holes 102 with respect to the guide block 92, so that manufacturing costs and the number of manufacturing steps can be reduced. Further, because space is not needed, which ordinarily would be required for processing and fabricating such ball circulation holes 102 directly in the guide block 92, the thickness dimension of the guide block 92 can be suppressed (i.e., the guide block can have a thinner profile), and as a result, the guide block 92 can be made smaller in scale.

Further, in the guide mechanism 16, the ball circulation passages 110 through which the balls 60 circulate are constructed from the ball circulation holes 102 of the ball circulation members 94*a*, 94*b*, the roll-reversing sections 104*a*, 104*b*, the second ball guide grooves 74 of the guide block 92, and the first ball guide grooves 62 of the slide table 14, wherein the ball circulation holes 102 are disposed so as to be offset vertically downward with respect to the first and second ball guide grooves 62, 74.

Furthermore, the second ball guide grooves 74 of the guide block 92 are positioned on outer sides from the workpiece retaining holes 72 of the slide table 14, which are disposed above the second ball guide grooves 74. Owing thereto, for example, even in the case that bolts, which are attached in the workpiece retaining holes 72, are tightened excessively such that the ends thereof are pressed in abutment against the guide block 92, since the ball circulation members 94*a*, 94*b* are disposed in lower portions of the guide block 92 on the side of the cylinder main body 12, pressing forces from the bolts can be prevented from being applied to the ball circulation members 94*a*, 94*b*.

As a result, the guiding function of the slide table 14, which is performed by the guide mechanism 16 including the balls 60 therein, is not impaired.

Further, because the ball circulation members 94*a*, 94*b*, which are formed as different members apart from the guide block 92, are installed in the guide block 92, thereby providing the ball circulation holes 102, it is unnecessary to consider the wall thickness or the like in the vicinity of the ball circulation holes 102 in the guide block 92, in comparison with a case in which such ball circulation holes 102 are formed directly in the guide block 92 by processing the guide block 92 directly. Owing thereto, it becomes possible for the ball circulation holes 102 of the ball circulation members 94*a*, 94*b* to be provided on the side of the cylinder main body 12, while it is unnecessary to increase the thickness of the guide block 92 for the purpose of forming the ball circulation holes 102, and as a result, the guide block 92 can be made thinner in profile.

Still further, in the slide table 14, since the thickness dimension of the base member 56 is substantially the same as the thickness dimension of the pair of guide walls 58*a*, 58*b*, the slide table 14 can be made thin-walled and lightweight. The slide table 14 can be manufactured by press molding, and thus, manufacturing costs for the slide table 14 can be reduced.

Further, because the end plate 54 is fixed from above by bolts 66*b* inserted from above, with respect to the other end of the base member 56 in the slide table 14, the thus-fixed end plate 54 enables the thickness of the base member 56 to be made thinner in comparison to a case of being fixed to the base member 56 of the slide table 14 from a frontward direction thereof. As a result, the slide table 14 including the base member 56 can be made thin-walled, and the slide table 14 can be made lightweight accordingly.

The linear actuator according to the present invention is not limited to the embodiment described above, but various alternative or additional features and structures may be adopted without deviating from the essence and scope of the invention as set forth in the appended claims.

What is claimed is:

1. A linear actuator in which, by introduction of a pressure fluid from fluid inlet/outlet ports, a slide table is made to move reciprocally along an axial direction of a cylinder main body, comprising:

the cylinder main body, which communicates with the inlet/outlet ports, and having a cylinder chamber into which the pressure fluid is introduced;

the slide table, which moves reciprocally along the axial direction of the cylinder main body;

a cylinder mechanism having a piston which is slidable along the cylinder chamber, wherein the slide table is made to move reciprocally under a displacement action of the piston;

a guide mechanism for guiding the slide table along the axial direction of the cylinder main body, the guide mechanism being attached to the cylinder main body and having a flat guide block with first circulation passages formed therein through which a plurality of rolling bodies roll and circulate; and circulation members installed in the guide block and each having a second circulation passage therein through which the rolling bodies roll and circulate, wherein openings into which the circulation members are installed are formed in the guide block, wherein the second circulation passages and respective first circulation passages are offset by a predetermined height in a vertical direction.

2. The linear actuator according to claim 1, wherein the circulation members are formed in a tubular shape each having the second circulation passage in the interior thereof.

3. The linear actuator according to claim 2, wherein the first circulation passages are formed on opposite side surfaces of the guide block, and the second circulation passages are disposed on the side of the cylinder main body with respect to the first circulation passages.

4. The linear actuator according to claim 1, wherein a workpiece retaining hole for fixing a workpiece is formed in the slide table, the workpiece retaining hole being disposed on an inner side with respect to the first circulation passages in a widthwise direction perpendicular to the axial direction.

5. The linear actuator according to claim 1, wherein the slide table further comprises:

a base member disposed on an upper part of the guide block; and a pair of guide members that extend downwardly from opposite sides of the base member, wherein the base member and the guide members are formed with substantially the same thickness.

6. The linear actuator according to claim 5, wherein the slide table further comprises an end plate connected to the piston through a piston rod, the end plate being disposed downwardly from the base member and being connected thereto by a fastening member which are inserted from above with respect to the base member.

7. The linear actuator according to claim 1, wherein the openings are formed with a substantially rectangular shape in cross section, and open downwardly of the guide block and at opposite ends thereof in the longitudinal direction of the guide block.

* * * * *